US006594836B1

(12) United States Patent
Everson et al.

(10) Patent No.: US 6,594,836 B1
(45) Date of Patent: Jul. 22, 2003

(54) BED SHEET WITH CONVENIENCE POUCHES

(76) Inventors: Scott Everson, 31162 Via Cristal, San Juan Capistrano, CA (US) 92675; Julie Everson, 31162 Via Cristal, San Juan Capistrano, CA (US) 92675

( * ) Notice: Subject to any disclaimer, the term of this patent is extended or adjusted under 35 U.S.C. 154(b) by 0 days.

(21) Appl. No.: 10/029,061

(22) Filed: Dec. 18, 2001

Related U.S. Application Data

(60) Provisional application No. 60/256,652, filed on Dec. 18, 2000.

(51) Int. Cl.[7] ..... A47G 9/02
(52) U.S. Cl. ..... 5/485; 5/503; 5/497
(58) Field of Search ..... 5/485, 482, 497, 5/499, 503.1

(56) References Cited

U.S. PATENT DOCUMENTS

| | | | | | |
|---|---|---|---|---|---|
| 1,269,276 | A | * | 6/1918 | Harris | 5/485 X |
| 2,162,755 | A | * | 6/1939 | Shauer | 5/497 |
| 2,624,893 | A | * | 1/1953 | Harris | 5/497 |
| 3,111,688 | A | * | 11/1963 | Barnes | 5/497 |
| 3,120,721 | A | * | 2/1964 | Bukatman et al. | 5/485 X |
| 4,005,499 | A | * | 2/1977 | Klein | 5/485 |
| 4,064,576 | A | * | 12/1977 | Threatt | 5/485 |
| 4,129,909 | A | * | 12/1978 | Riehl | 5/503.1 |
| 4,442,558 | A | | 4/1984 | Alexander | 5/494 |
| 5,029,353 | A | * | 7/1991 | Kimball et al. | 5/497 |
| 5,279,009 | A | | 1/1994 | Putka, Jr. | 5/485 |
| 5,581,829 | A | * | 12/1996 | Lee | 5/503.1 |
| 5,605,235 | A | * | 2/1997 | Johnson | 5/503.1 X |
| 5,737,785 | A | * | 4/1998 | Casey | 5/485 X |
| 5,758,972 | A | * | 6/1998 | Mack et al. | 5/503.1 |
| 5,956,768 | A | | 9/1999 | Pearson | 2/69.5 |
| 6,148,459 | A | * | 11/2000 | Verhulst | 5/503.1 |
| 6,178,574 | B1 | * | 1/2001 | Stromatt et al. | 5/485 |
| 6,233,763 | B1 | * | 5/2001 | Spaan | 5/485 |
| 6,233,765 | B1 | * | 5/2001 | Verhulst | 5/503.1 |
| 6,292,963 | B1 | * | 9/2001 | Couture | 5/503.1 |
| 6,374,440 | B1 | * | 4/2002 | Thim, Jr. | 5/503.1 X |
| 6,496,992 | B2 | * | 12/2002 | Saparow | 5/482 |
| 2002/0018601 | A1 | * | 2/2002 | Nelson | 5/503.1 |
| 2002/0095727 | A1 | * | 7/2002 | Saparow | 5/482 |

FOREIGN PATENT DOCUMENTS

| | | | | |
|---|---|---|---|---|
| GB | 13980 | * | 8/1896 | 5/485 |
| GB | 1472559 | * | 5/1977 | 5/485 |
| GB | 2173095 A | * | 10/1986 | 5/485 |
| GB | 2198348 A | * | 6/1988 | 5/485 |

* cited by examiner

*Primary Examiner*—Robert G. Santos
(74) *Attorney, Agent, or Firm*—Knobbe, Martens, Olson & Bear LLP

(57) ABSTRACT

A bedding element comprising a fitted bottom sheet having one or more elasticized convenience pouches sewn onto both lateral sides of the sheet. The purpose of the convenience pouches are to provide a suitable location for a person in bed to temporarily and conveniently store any number of items that are commonly used while in bed. The pouches are elasticized and open at the top to allow for easy access, and closed on the sides and bottom to keep stored items from falling out.

18 Claims, 3 Drawing Sheets

BED SHEET WITH CONVENIENCE POUCHES

RELATED APPLICATIONS

The present application claims priority under 35 U.S.C. §119(e) to U.S. Provisional Application No. 60/256,652, filed Dec. 18, 2000.

BACKGROUND

1. Field of the Invention

The invention relates in general to the field of bedding, and specifically to a bed sheet with integral convenience pouches.

2. Description of the Related Art

Over the past several years, developments in areas such as electronics, healthcare, home and personal security, household conveniences, and food and beverage preparation have resulted in an onslaught of small, portable items that are frequently used by individuals while in bed. Until now, such items have generally been placed either on the bed, on the bedside table, and/or headboards, or on the floor. The result has been increased clutter on and around the bed and/or the inability to quickly and conveniently access such items while in bed.

It is therefore desirable to provide an alternate storage space for such items as television and stereo remote controls, reading glasses, portable communication devices such as cordless phones and pagers, medications, jewelry, and wristwatches, contraceptives, water bottles, flashlights, and virtually innumerably other items that are frequently used while in bed.

SUMMARY

Thus the present discussion provides a fitted bed sheet with integral convenience pouches sewn onto the sides. The sheets and pouches may be fabricated to various specifications depending on the intended purpose of the user. For example, healthcare institutions such as hospitals, retirement homes and skilled nursing facilities will likely have specific requirements for the sheet and pouch design that will greatly enhance safety and convenience by making needed items more accessible to bedridden individuals. Additionally, the sheet and pouch design may be modified to meet the specific needs of other age groups such as infants, adolescents, and teenagers.

Accordingly, an object of the present invention is therefore to provide a convenient location for the temporary storage of various small items frequently used while in bed. This is accomplished by fabricating fitted bottom bed sheets that contain elasticiesd pouches of various sizes sewn onto one or both sides of the sheet.

One embodiment of a bed sheet having desired features and advantages preferably comprises a fabric sheet adapted to be tightly disposed on a mattress such that said sheet has a top, a plurality of long sides lying in a substantially vertical plane, and a plurality of short sides lying in a substantially vertical plane said fitted bed sheet having at least one pouch attached to at least one of said sides of said sheet.

The pockets may comprise re-enforced stitching, a top edge of said pockets may comprise an elastic band. The pocket may be disposed on one of the long vertical sides. In one embodiment, the pocket comprises a length of at least 50% of a length of the long side of the sheet. The pocket may be divided into a plurality of smaller portions by providing at least one vertical stitch along the length of said pocket. Pouches may be provided on one or both long sides of said sheet.

Another embodiment of a bed sheet having preferred features and advantages is adapted to cover a rectangular mattress top surface, a plurality of substantially rectangular mattress side surfaces, and at least a portion of a bottom surface of a mattress; at least one pouch sewn onto a side surface of the sheet; the sheet having reinforced stitching, oversized corners, and the pouch may comprise pleats.

Additionally, in further embodiments, an upper edge of the pouch comprises an elastic band, the pouch may be made of the same material as the sheet, an upper edge of the pouch may comprise a zipper or other closure device. In one embodiment, the pouch is between 4 and 6 feet long, and may be divided into a plurality of smaller pockets by vertical seams. Pouches may be provided on two long side surfaces, or on one or both short surfaces.

In another embodiment, a method of making sheet with integral convenience pouches is provided. The method generally comprises: providing a substantially rectangular piece of fabric with a length equal to a mattress length plus twice a mattress depth plus at least 4" and a fabric width equal to a mattress width plus twice a mattress depth plus at least 4"; cutting a square equal to the mattress depth plus at least 4" from each corner of said rectangular piece of fabric; stitching said corners with reinforcing tape; sewing heavy duty elastic into the corners; providing a pouch material having a length of at least 70% of the mattress length; sewing said pouch material onto a long side of said rectangular piece of fabric, and sewing an elastic strip into a top edge of said pouch fabric such that a pouch having at least three enclosed sides is formed on a side of said rectangular piece of fabric.

Further embodiments of a method of making a suitable sheet may comprise the step of providing at least one vertical stitch in the pouch, thus dividing the pouch into at least two smaller pockets. Pleats may be provided in the pouch material, and a zipper may be provided on an upper edge of the pouch. The sheet may be made of linen or any other fabric suitable for use in bedding.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the present invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF DRAWINGS

Having thus summarized the general nature of the invention, certain preferred embodiments and modifications thereof will become apparent to those skilled in the art from the detailed description herein having reference to the figures that follow, of which.

DETAILED DESCRIPTION

Figure 1:
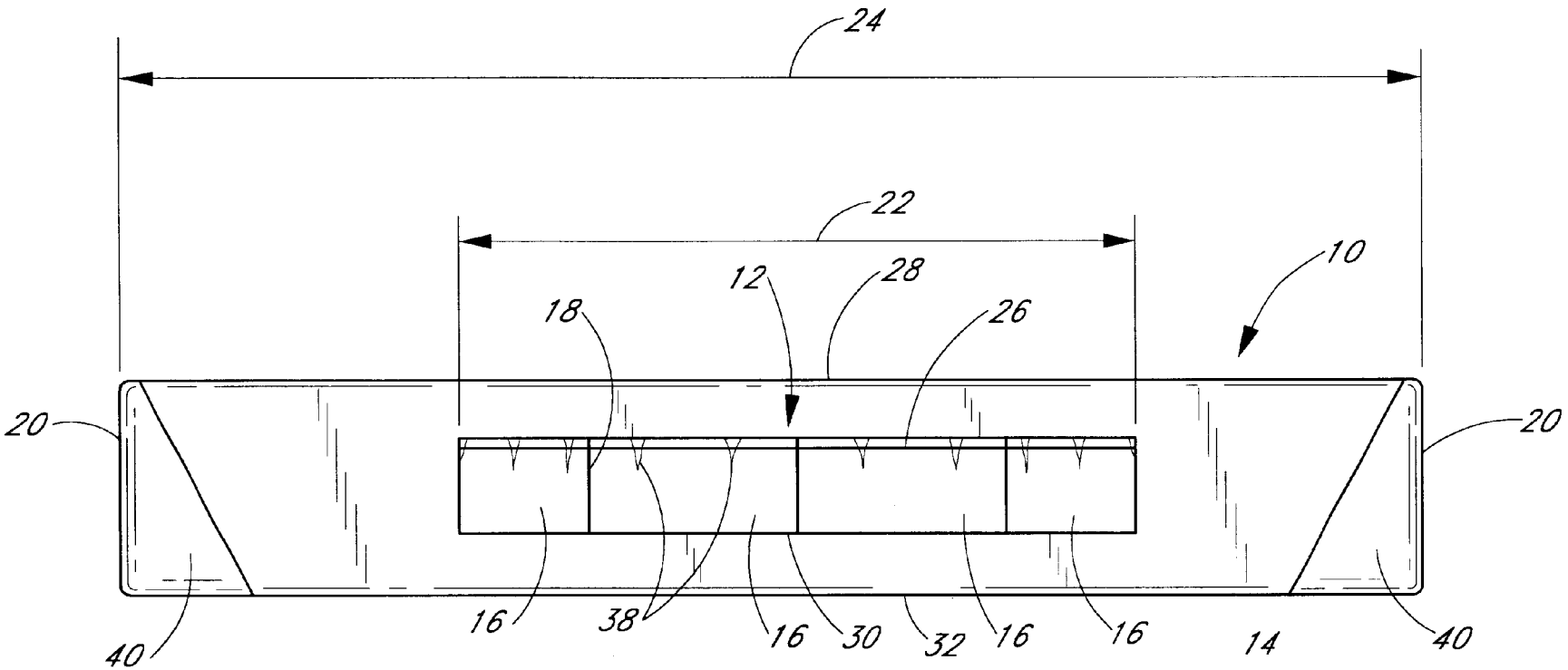
FIG. 1 is a side elevation view of a mattress and fitted bed sheet having preferred features and advantages.

FIG. 1 shows a side view of a typical fitted bottom sheet 10 with a convenience pouch 12 attached on a side 14 of the sheet 10. The pouch 12 may comprise a single longitudinal pocket, or it may be divided into a plurality of smaller pockets 16 by the provision of vertical seams 18. Alternatively, a plurality of pockets may be separately provided as desired.

Figure 2:
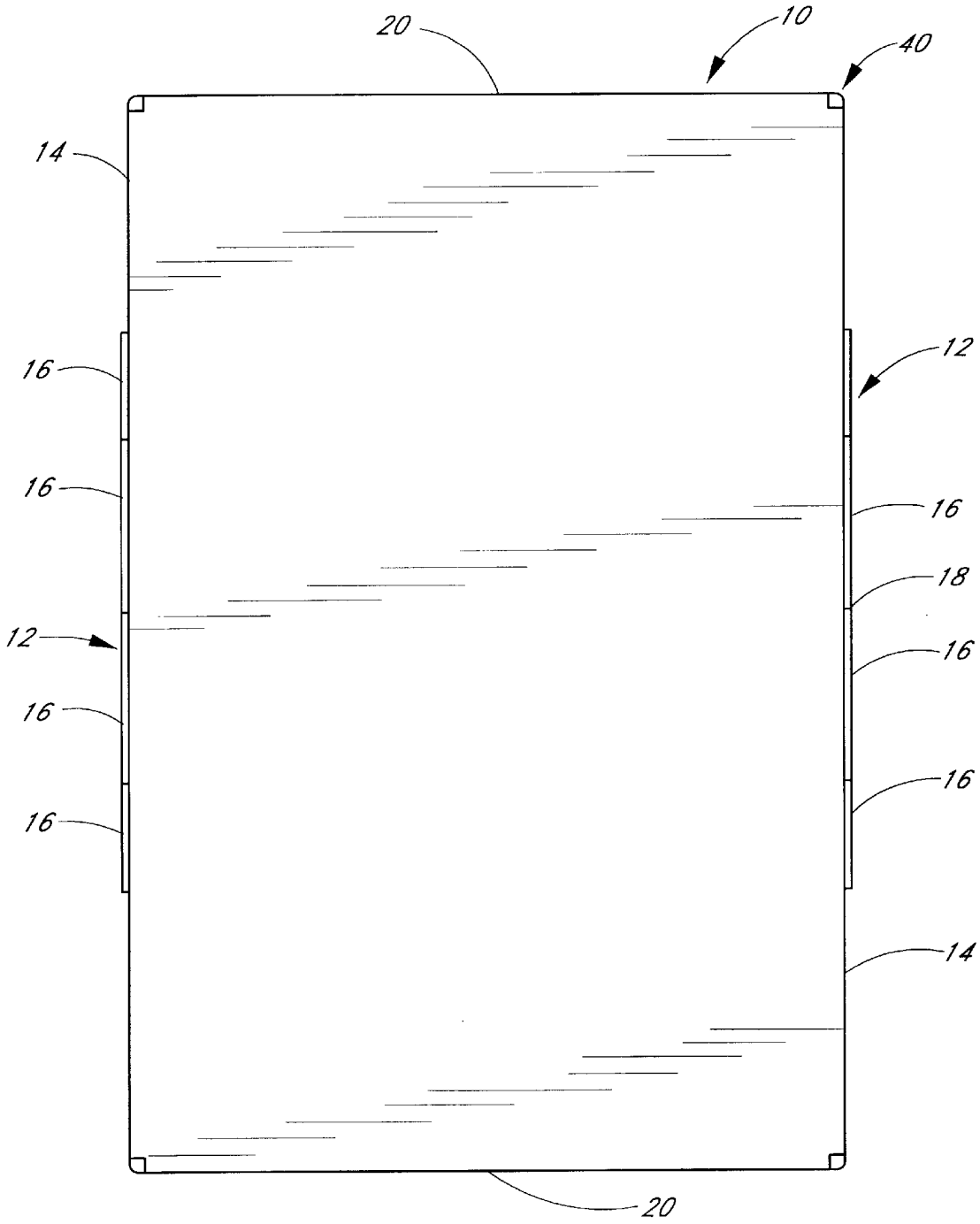
FIG. 2 is a top view of the mattress and fitted sheet of FIG. 1.
Figure 3:
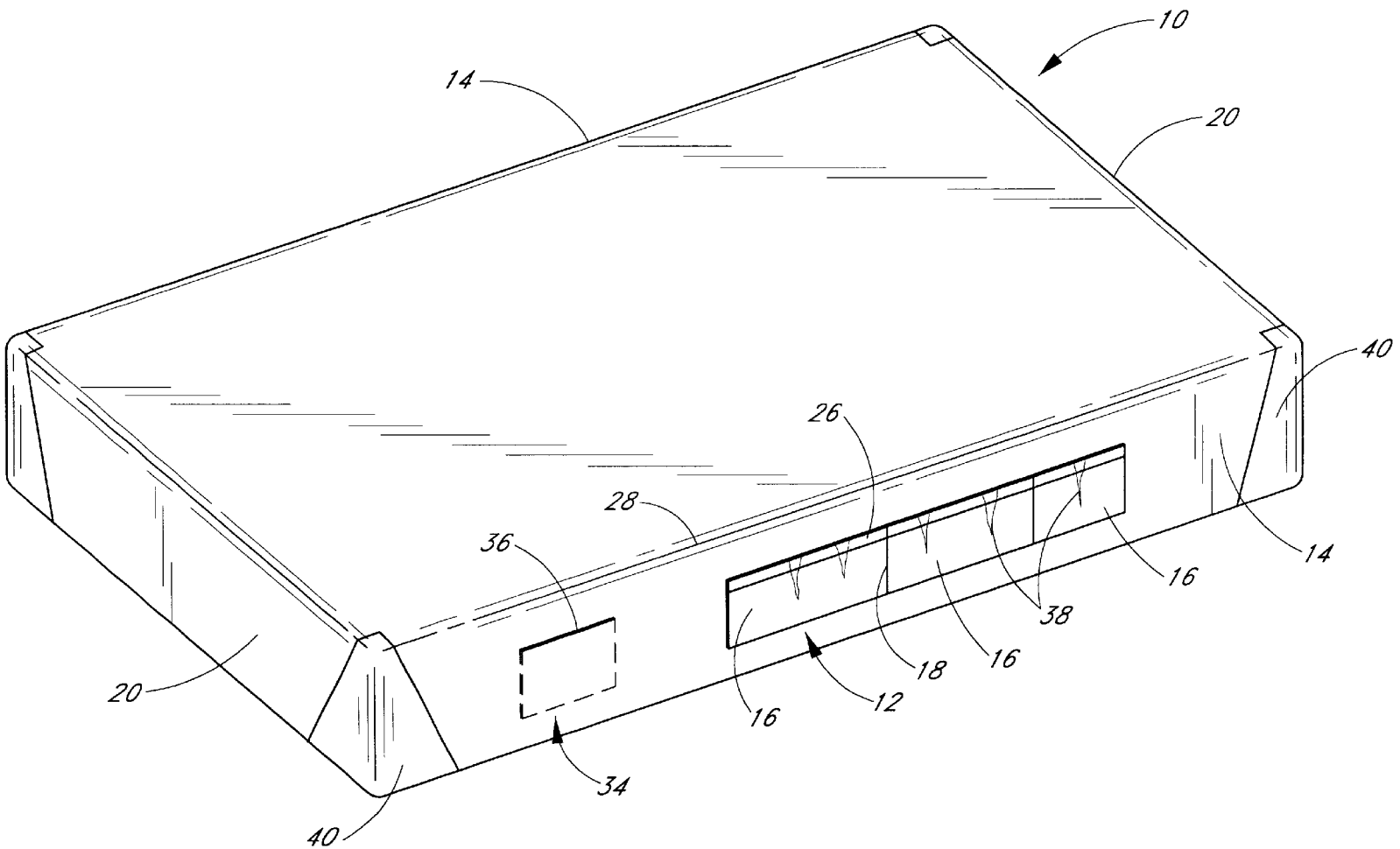
FIG. 3 is a perspective view of the mattress and fitted sheet of FIG. 1.

In FIGS. 1, 2 and 3 pouches 12 are shown centered horizontally and vertically on lateral sides 14 of the sheet 10. The convenience pouches 12 are preferably centered on the lateral sides 14 of the bottom sheet 10, thereby enabling the sheet 10 to be placed over the mattress with either end at the head of the bed without negatively affecting the user's ability to conveniently access a pouch 12. Alternatively the pouches 12 may be positioned at any convenient location on any vertical edge of the sheet 10. Thus, for example, a pouch may be provided at an end 20 of the sheet, or a pouch may be positioned So on a side 14 of the sheet substantially near either end 20. The width 22 of the pouch 12 shown in FIG. 1 is equivalent to approximately ⅔ the length of the mattress 24, and centered on a side of the bottom sheet 10. Pouches may be provided in any desired shape depending on the items or type of items to be stored therein.

The specific height of the pouches 12 may vary according to the thickness of the mattress that the bottom sheet 10 is designed to fit. Those skilled in the art will recognized that a fitted bottom sheet with integral convenience pouches may be adapted to fit any particular mattress size or shape, such as a twin, double, queen, king etc. Generally, however the top edge 26 of the pouch will preferably be approximately one inch below the top edge 28 of the mattress, and the bottom edge 30 of the pouch 12 will preferably be approximately one inch above the bottom edge 32 of the mattress. Those skilled in the art will recognize that many pouch sizes and shapes may be employed depending on the particular items intended to be stored therein. Thus, the pouches 12 may comprise a substantially elliptical shape or any other geometrical shape as viewed from the side. Pouches 12 may contain one or more vertical seams 18 sewn, into the pouch, thereby dividing one wide pouch into two or more smaller pockets 16.

With reference now to FIG. 3, The pouches 12 generally comprise portions of material attached to the outside of a vertical edge 14, 20 of a fitted sheet 10 preferably by sewing. Those skilled in the art of sewing will recognize that many stitching patterns and seam patterns may be used for attaching a pouch to a fitted bed sheet 10 as described herein. Alternatively, the pouches 12 may be attached to the bed sheet by any other method known to those skilled in the art, such as hot glue, hook and loop closures (known as Velcro®), zippers, etc. Furthermore, those skilled in the art will recognize that hidden pockets 34 may be formed by providing an opening 36 in a portion of the vertical side 14 of the sheet 10, and attaching a pocket 34 to an inside of the sheet such that the pocket 34 is substantially "hidden" inside the sheet.

The sheet 10 and pouches 12 are preferably made in such a manner as to allow items to be easily slipped into the pouch 12 or retrieved therefrom through an elasticized opening 26 at the top of the pouch 12. Thus the fabric of the pouches 12 preferably comprise a plurality of pleats 38 or darts as will be understood by those skilled in the art. The pleats 38 allow the material of each pocket 16 to be expanded to provide a substantially large volume space for storing items therein, while maintaining a relatively low profile when the pockets 16 are empty. The top edges 26 of the pockets 16 preferably comprise elastic adapted to hold the top edge 26 of the pockets 16 substantially closed. The pockets may additionally comprise other closure systems such as hook and loop closures (known as Velcro®), zippers, buttons, snaps, toggles, or any other closure system known to those skilled in the art.

FIG. 2 shows top view of a fitted bottom sheet 10 with convenience pouches 12 on each lateral side 14. The bottom fitted bed sheet 10 is preferably made in such a manner that it will remain securely in place about the mattress upon which the sheet 10 is fitted. A sheet 10 having preferred features and advantages preferably includes substantial reinforcing. The four corners of the fitted sheet 10 preferably have oversized corner boxes 40 and heavy duty elastic. Those skilled in the art will recognize that standard fitted sheets extend only slightly under the bottom surface of a mattress. The oversized and reinforced corner pockets 40 extend significantly further under the mattress than would be found in a standard fitted bed sheet. The oversized corner boxes 40 also preferably comprise portions of material disposed at each corner such that they extend substantially under the corner of the mattress such that the sheet 10 will be tightly held to the mattress. The corner boxes may comprise triangular portions of heavier material (such as canvas or denim) on the inside surface of the sheet in order to provide additional reinforcement. This will promote enhanced functionality of the convenience pouches 12 by ensuring that the sheet 10, pouches 12, and pockets 16 maintain their intended shape and remain in one place on the mattress, even while objects are being stored in the pouches 12.

As will be understood by those skilled in the art, all of the seams of the sheet are preferably reinforced by providing a portion of thicker material on an inside surface of the sheet 10 in order to prevent the seams from tearing the material of the sheet 10. A bed sheet having preferred features and advantages may be made from any suitable material known to those skilled in the art, such as linen, silk, flannel, etc.

A method of making a bed sheet with integral convenience pouches generally comprises providing a substantially rectangular piece of fabric with a length equal to the length of the mattress plus twice the depth of the mattress plus at least 4" (preferably at least 6") and a fabric width equal to the width of the mattress plus twice the depth of the mattress plus at least 4" (preferably at least 6') for the oversized corners. Then a square equal to the depth of the mattress plus the additional length is cut from each corner. For example, if the mattress is 8" thick, then a square with a side equal to at least 12", (and preferably at least 14') is cut from each corner. The corner seams are then stitched together, and reinforced, and heavy duty elastic is sewn into the corners. Material for the pouches is then provided with sufficient length for providing the desired pleating. The pouches are then preferably sewn onto the long sides of the sheet, and an elastic strip is sewn into the top edge.

The fitted bed sheet having integral convenience pouches is shown and described herein as it would be disposed on a mattress. Those skilled in the art will recognize that the sheet may be placeable in many orientations, and that the orientation of the sheet chosen for the present discussion is a matter of convenience.

Although certain preferred embodiments and examples have been described herein, it will be understood by those skilled in the art that the present inventive subject matter extends beyond the specifically disclosed embodiments to other alternative embodiments and/or uses of the invention and obvious modifications and equivalents thereof. For example, those skilled in the art will recognize that a sheet with integral convenience pouches/pockets may also be adapted for use with a box spring mattress. Thus, it is intended that the scope of the present inventive subject matter herein disclosed should not be limited by the particular disclosed embodiments described above, but should be determined only by a fair reading of the claims that follow.

What is claimed is:

1. A bed sheet comprising;

a fabric sheet adapted to be tightly disposed on a mattress such that said sheet has a top, a plurality of long sides lying in a substantially vertical plane, and a plurality of short sides lying in a substantially vertical plane;

said sheet comprising oversized corner portions made of a material of a heavier weight than the material of the remainder of the sheet;

at least one pouch attached to at least one of said long sides of said sheet, at least the corner seams of said pouch comprising reinforced stitching;

wherein the at least one pouch occupies at least half the length of a long side of said sheet and wherein the pouch is centrally located such that ends of the pouch are equally distant from opposite short sides of the sheet, such that the pouch is accessible to an occupant with a head adjacent either short side;

the pouch comprising a lower edge which is at least one inch above the bottom of the mattress.

2. The bed sheet of claim 1 wherein a top edge of said at least one pouch comprises an elastic band.

3. The bed sheet of claim 2 wherein said at least one pouch comprises a length of at least 60% of a length of said long side of said sheet.

4. The bed sheet of claim 3 wherein said at least one pouch is divided into a plurality of smaller portions by providing at least one vertical stitch along the length of said pocket.

5. The bed sheet of claim 1 wherein said sheet comprises pouches provided on two long sides of said sheet.

6. A bed sheet comprising:

a bed sheet adapted to cover a rectangular mattress top surface, a plurality of substantially rectangular mattress side surfaces, and at least a portion of a bottom surface of a mattress;

at least one pouch sewn centrally onto a long side surface of said sheet;

said sheet having reinforced stitching;

said sheet having oversized corners of a material with a heavier fiber weight than a material of the remainder of the sheet;

wherein the at least one pouch is equidistant from ends of the long side of the sheet.

7. The bed sheet of claim 6 wherein said at least one pouch comprises pleats.

8. The bed sheet of claim 7 wherein an upper edge of said at least one pouch comprises an elastic band.

9. The bed sheet of claim 7 wherein said at least one pouch is made of the same material as the sheet.

10. The bed sheet of claim 6 wherein an upper edge of said at least one pouch comprises a zipper.

11. The bed sheet of claim 8 wherein said at least one pouch is between 4 and 6 feet long.

12. The bed sheet of claim 11 wherein said at least one pouch is divided into a plurality of smaller pockets.

13. The bed sheet of claim 12 comprising pouches on two long side surfaces of said sheet.

14. A method of making sheet with integral convenience pouches comprising;

providing a substantially rectangular piece of fabric with a length equal to a mattress length plus twice a mattress depth plus at least 4" and a fabric width equal to a mattress width plus twice a mattress depth plus at least 4";

cutting a square equal to the mattress depth plus at least 4" from each corner of said rectangular piece of fabric;

providing a triangular piece of fabric of a heavier fiber weight than the rectangular piece of fabric;

stitching said corners with reinforcing tape;

sewing the triangular piece of fabric into the corners;

sewing heavy duty elastic into the corners;

providing a pouch material having a length of at least 70% of the mattress length;

sewing said pouch material onto a long side of said rectangular piece of fabric such that ends of said pouch material are equidistant from ends of said rectangular piece of fabric, and sewing an elastic strip into a top edge of said pouch fabric such that a pouch having at least three enclosed sides is formed on a side of said rectangular piece of fabric.

15. The method of claim 14 further comprising the step of providing at least one vertical stitch in said pouch material, thus dividing said pouch material into at least two smaller pockets.

16. The method of claim 15 further comprising providing pleats in said pouch material.

17. The method of claim 14 further comprising providing a zipper on an upper edge of said pouch material.

18. The method of claim 14 wherein said rectangular piece of fabric is made of linen.

* * * * *